United States Patent [19]

Nuttall

[11] 4,358,342

[45] Nov. 9, 1982

[54] PAPERMAKING HEADBOX HAVING RIGID LIPS AND ACTVATING MEANS

[75] Inventor: David A. Nuttall, Neenah, Wis.

[73] Assignee: Kimberly-Clark Corporation, Neenah, Wis.

[21] Appl. No.: 226,185

[22] Filed: Jan. 19, 1981

[51] Int. Cl.[3] ..... D21F 1/02; D21F 1/06

[52] U.S. Cl. ..... 162/259; 162/347

[58] Field of Search ..... 162/344, 347, 252, DIG. 11, 162/212, 259

[56] References Cited

U.S. PATENT DOCUMENTS

| | | | |
|---|---|---|---|
| 2,928,464 | 3/1960 | Western et al. | 162/347 |
| 3,373,080 | 3/1968 | Appel et al. | 162/344 |
| 3,703,436 | 11/1972 | Rice | 162/DIG. 11 |
| 4,181,568 | 1/1980 | Pfaler | 162/347 |

*Primary Examiner*—Steve Alvo

*Attorney, Agent, or Firm*—Gregory E. Croft; William D. Herrick

[57] ABSTRACT

A papermaking headbox with adjustable rigid slice lips especially adapted to permit deflection of the slice lips on a headbox utilized with a twin wire or crescent forming papermaking machine. The headbox comprises elongated slice lips extending into the forming zone located between converging papermaking wires or fabrics, the slice lips being substantially rigid in construction and affixed at their rearmost ends to headbox support members. One or both of the slice lips may be provided with a full width machined channel into which the actuating means in the form of relatively inflexible bellows are positioned. These metal bellows are in turn connected to a fluid supply means which cause a small axial movement only. The fluid supply means is adapted to supply a fluid under pressure of at least 1,000 pounds per square inch to the bellows, such that upon actuation of the bellows, the slice lip will be deformed, thereby restricting the slice opening. The full width channel provides a uniform flexure point for the adjustable slice lip.

7 Claims, 8 Drawing Figures

PAPERMAKING HEADBOX HAVING RIGID LIPS AND ACTVATING MEANS

BACKGROUND OF THE INVENTION

With the advent of modern papermaking techniques, paper machine speeds and width have increased to more than 5,000 feet per minute and 200 inches respectively. As speeds and widths increase, the difficulty in making a product with uniform machine- and cross-machine (c.d.) direction profiles increases concurrently. In the manufacture of quality tissue or towel products for wiping purposes, control of the c.d. basis weight profile is important to produce consistently uniform products acceptable to the customer in both feel, performance and sight characteristics.

Nonuniformities in the c.d. profile are primarily caused by irregularities in the slice opening, the opening in the headbox from which the papermaking furnish exits. It is known in the art to provide means to deform one or both of the lips forming the slice opening in order to adjust the basis weight profile to even out undesirable c.d. variations. These lip-deforming means usually have taken the form of mechanical devices, such as rods or spindles, secured to one of the lips. By affixing these rods at selected intervals across the width of the lip, one or more selected rods may be actuated up or down in order to open or close that portion of the slice opening as desired.

The devices described above function adequately for so-called Fourdrinier type machines, or single wire machines in which the paper stock is laid on a single moving wire beneath the headbox. However, the newer generation high speed machines often utilize a "twin wire" or "crescent former" configuration in which the papermaking stock is introduced in a jet into a forming zone in a hydraulic nip formed between two converging wires or a converging wire and felt. In certain designs, when the inlet lips have to be positioned as close as possible into the forming zone, space is at a premium and such mechanical devices are too cumbersome and difficult to adjust to be used effectively. One such inlet is the Kimberly-Clark Turbulent Slot or Parallel Lip design, explained below.

The construction of the headbox channel immediately upstream from the slice opening has been effected in different ways to produce different results. Certain papermakers and manufacturers build headboxes with upper and lower stock flow channels in the lips converging toward the slice opening, thereby producing a uniform stock jet issuing from the headbox. Other papermakers have chosen to construct headboxes with upper and lower stock flow channel walls parallel to one another, thereby producing a turbulent stock jet which proportedly provides better mixing of the fibers in the stock jet. A benefit incident to the converging wall type inlet is that the stock jet issuing from the headbox remains intact for a considerable distance after exiting the headbox. Therefore, in a twin wire machine or a crescent former machine, the headbox can be backed away from the nip between the wires and the stock jet may be "shot" into the nip. By contrast, the stock jet issuing from a parallel-lip headbox disintegrates soon after leaving the headbox, so that the slice opening must be placed within the forming zone very near the nip.

In U.S. Pat. No. 2,928,464, Western et al, it is proposed to provide a headbox of the converging wall type with flexible slice lips backed by rigid support members, with expandable bags or capsules placed therebetween which deflect the flexible lips at appropriate points. The bags are fluid filled and connected to a bellows or pump so that the pressure may be varied to open or close the slice opening at any particular point along its width. The flexible slice lips require very little pressure exerted thereon to effect the deflection desired due to the flexible nature of the slice lips. Therefore, the bags are constructed of rubber, polyethylene, polyvinyl chloride or other suitable flexible materials, which is sufficient to withstand the low pressure levels required.

However, in the headbox utilized by Applicant, in which the slice lips are rigid members extending a substantial distance beyond the headbox support members into the forming zone, and which the support members and the slice lips are relatively thin, such devices would be unacceptable.

Therefore, there is an immediate need for means which are suitably compact to satisfy the limited space requirements of a twin wire or crescent forming system, yet having the capability to deflect a relatively rigid slice lip in order to correct c.d. basis weight nonuniformities.

SUMMARY OF THE INVENTION

In the present invention, there is a papermaking machine headbox typically utilized with twin wire or crescent forming machines, adapted to be positioned adjacent the nip formed between the converging papermaking wires or fabrics. The slice opening of the headbox formed between upper and lower slice lips may be adjusted to reduce basis weight nonuniformities by actuation of actuating means positioned within the slice lip. The actuating means are provided in the form of expandable bellows which are connected to a fluid supply means capable of supplying fluid to the actuating means at pressures exceeding 1,000 pounds per square inch.

Flexibility of the slice lips are provided by flexure means in the form of a full width cross machine channel machined in the slice lip and into which the bellows is positioned. Upon expansion of the actuating means, the slice lip is locally deformed inwardly, with flexure occuring at a rearmost portion of the groove.

Due to the relatively high pressures needed to deform the relatively inflexible slice lips, the actuating means is preferably provided of a substantially nonflexible material, such as stainless steel. The actuating means need only be expanded approximately 0.002 to 0.003 inches, which will produce a deflection at the tip of the slice lip of from 0.010 to 0.015 inches. Such deflection will be sufficient to correct most basis weight nonuniformities.

The actuating means may be interconnected with a sensing device located downstream from the headbox such that the appropriate actuating means would be expanded or contracted automatically whenever the basis weight exceeds a preset variation from a target basis weight.

DETAILED DESCRIPTION OF THE INVENTION

Figure 1A:
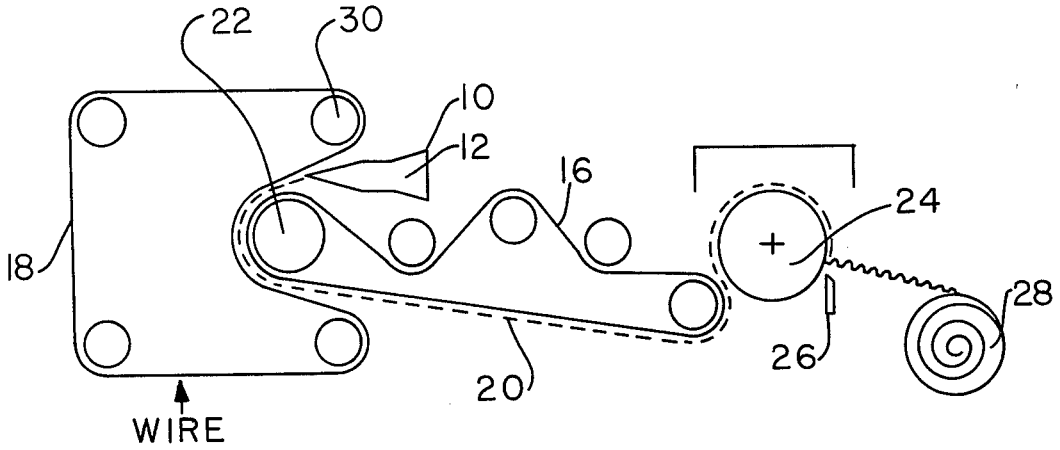
FIG. 1A is a diagrammatic view illustrating a papermaking machine utilizing a crescent forming configuration.
Figure 1B:
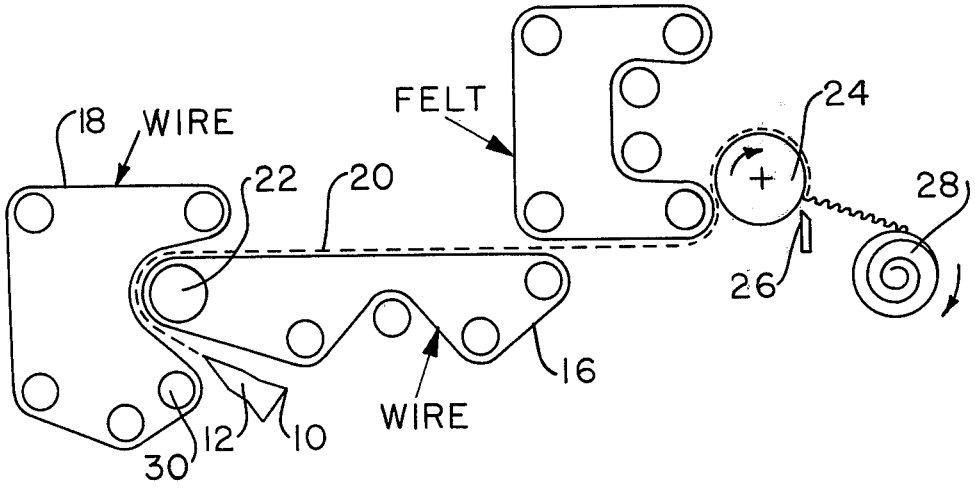
FIG. 1B is a diagrammatic view illustrating a papermaking machine utilizing a twin wire configuration.

In a twin wire or crescent-former type papermaking machine, shown generally in FIGS. 1A and 1B, there is a headbox 10 which monitors the flow of papermaking stock 12 into a forming area 14, which is formed by the convergence of a forming wire 18 and a second fabric 16. In the crescent former of FIG. 1A, the second fabric is a felt, while in the twin wire former of FIG. 1B the second fabric is a wire. The paper web 20 thus formed is partially dewatered by the compression of fabrics 16 and 18 around forming roll 22. The web 20 is thereafter affixed to a creping cylinder 24, dried and creped off with doctor blade 26 prior to being wound into a roll of creped product 28.

Figure 2:
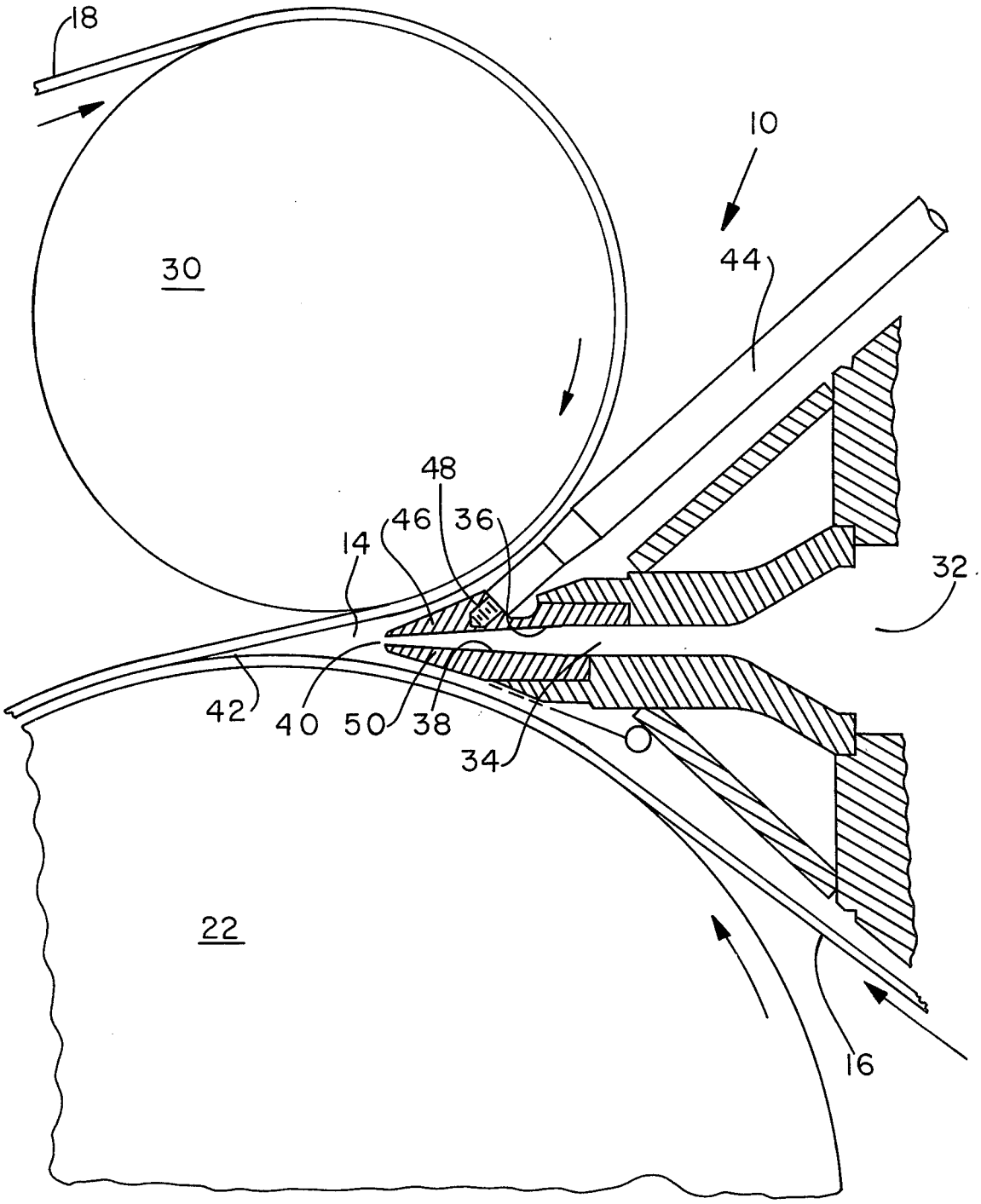
FIG. 2 (PRIOR ART)
FIG. 2 is an enlarged side sectional view of a papermaking machine of FIG. 1 utilizing a headbox having mechanical lip adjusters of a type known in the prior art.

A prior art form of adjustable headbox is shown in FIG. 2, this headbox having a stock flow channel of the converging wall type. As shown in FIG. 2, forming wire 16 and dewatering wire 18 converge toward forming area 14 and thereafter travel around forming roll 22. The headbox 10 is positioned as close as possible to the forming roll 22 and breast roll 30 within forming zone 14. The headbox is provided with one or more stock supply means 32 through which papermaking stock is pumped for distribution through the stock supply channel 34, from which it is propelled to the forming zone 14. The upper 36 and lower 38 walls of the stock supply channel may converge to a narrow slice opening 40, thereby producing a nonturbulent jet of papermaking stock. Such a nonturbulent jet will remain cohesive for a substantial distance, thereby permitting the headbox to be positioned as in FIG. 2 with the slice opening 40 a considerable distance from the juncture 42 of wires 16 and 18.

Variations in basis weight in the cross machine direction (c.d.) in a headbox as shown in FIG. 2 are corrected with the use of a rod or spindle 44 which is securedly attached to the upper lip 46 of headbox 10, as at 48. By actuating a mechanism such as a worm or screw gear affixed to an upper end of rod 44 (not shown), the rod 44 may be pushed downwardly, thereby restricting the slice opening 40, or pulled upwardly, thereby opening the slice opening 40, in the immediate area adjacent the rod 44. It is to be understood that a plurality of rods 44 are positioned across the width of headbox 10 so that local areas of the upper lip 46 may be deflected in order to correct local c.d basis weight nonuniformity. In appropriate circumstances, the rod 44 may be affixed to a lower lip 50 of a headbox, either with or without similar rods affixed to the upper lip 46.

Figure 3:
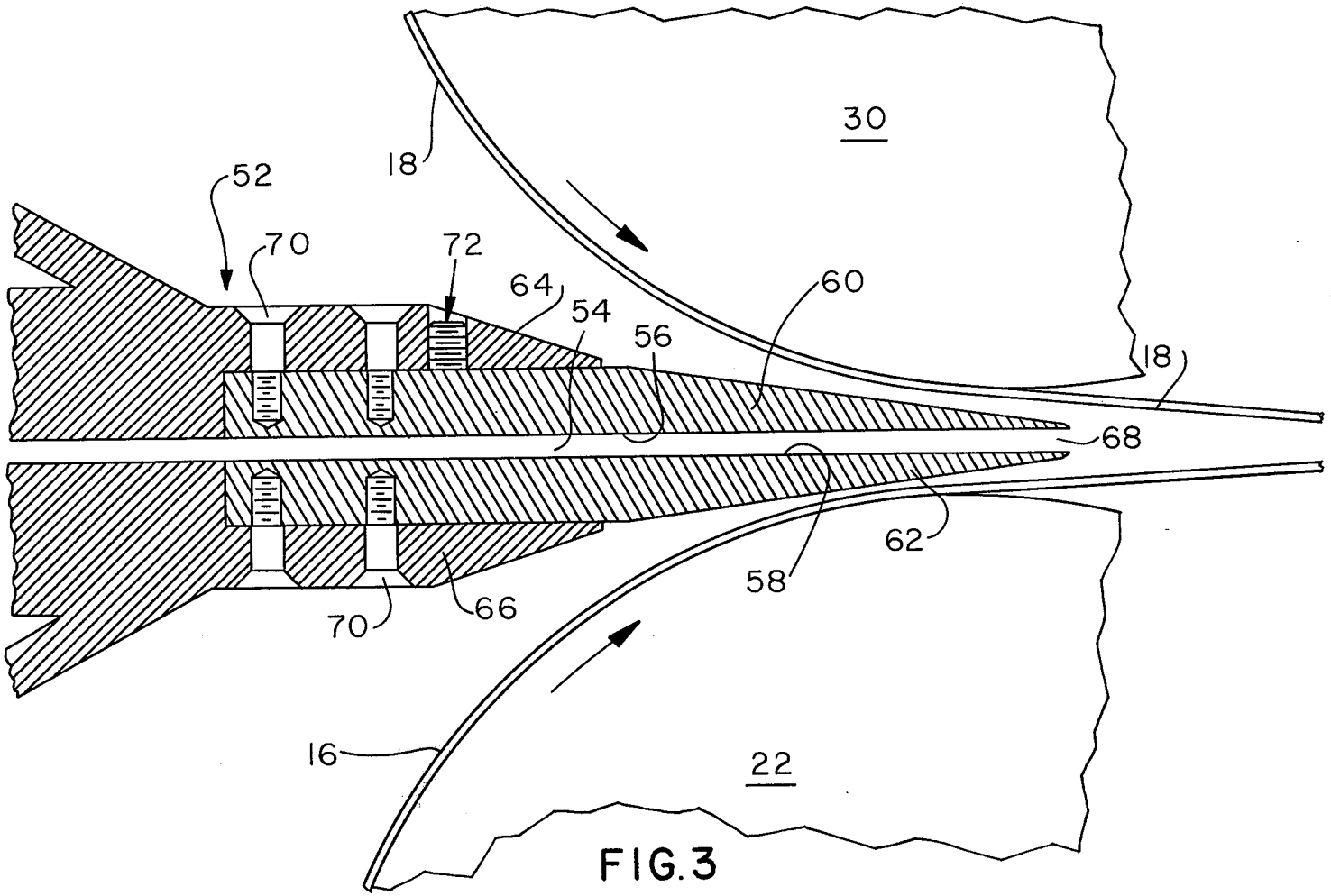
FIG. 3 is a side sectional view of a headbox of the type used by Applicant with an adjustable feature as used by Applicant prior to the present invention.

A headbox 52 similar to those used by applicant presently, is shown in FIG. 3. This headbox is of the parallel-wall type, with the stock supply channel 54 having upper 56 and lower 58 walls arranged parallel to one another, as opposed to converging walls as shown in FIG. 2. As is apparent from FIG. 3, the upper and lower lips, 60 and 62 respectively, are extended an appreciable distance past the support members 64 and 66 of the headbox, thereby providing a slice opening 68 a substantial distance from the headbox itself. It is to be noted that the upper and lower lips 60 and 62 are affixed to the headbox at their rearmost ends, as by set screws 70, and are constructed of a relatively rigid, thick material, such as stainless steel.

The parallel walls 56 and 58 of the headbox of FIG. 3 create a turbulent stock jet exiting from slice opening 68, which Applicant believes provides better intermixing of fibers within the stock jet leading to better formation of webs formed therefrom. However, the turbulent nature of the stock jet leads to its tendency to "break down" soon after leaving the slice opening, so that the slice opening must be positioned extremely close to the juncture of fabrics 16 and 18. For example, a slice opening 68 of approximately 0.38", with the end of lips 60 and 62 positioned approximately 0.3" from fabrics 16 and 18 has been found to provide excellent formation. Applicant has found that the only manner in which this may be accomplished is to extend the lips of the headbox, since the headbox itself is too large to be positioned within the forming zone.

Prior to the present invention, c.d. basis weight nonuniformities in a headbox as shown in FIG. 3 were corrected by adjusting one or both of the lips 60 and 62 by means of jacking screws 72 positioned in either the upper or lower support members 64, 66. Such screws function adequately for the desired purpose in that they require no additional space in or external to the headbox, and effect adequate deflection of the lip to even out c.d. nonuniformities. However, due to their location, the jacking screws 72 may be adjusted only when the machine is shut down and the headbox withdrawn from the forming zone, such that, as a practical matter, the headbox is adjusted quite infrequently. Additionally, since the headbox may not be adjusted "on the run" any adjustment made while the machine is shut down may not totally remove the nonuniformity existing prior to the shutdown, or in fact may produce new nonuniformities which do not become apparent until the machine is again started up.

Figure 4:
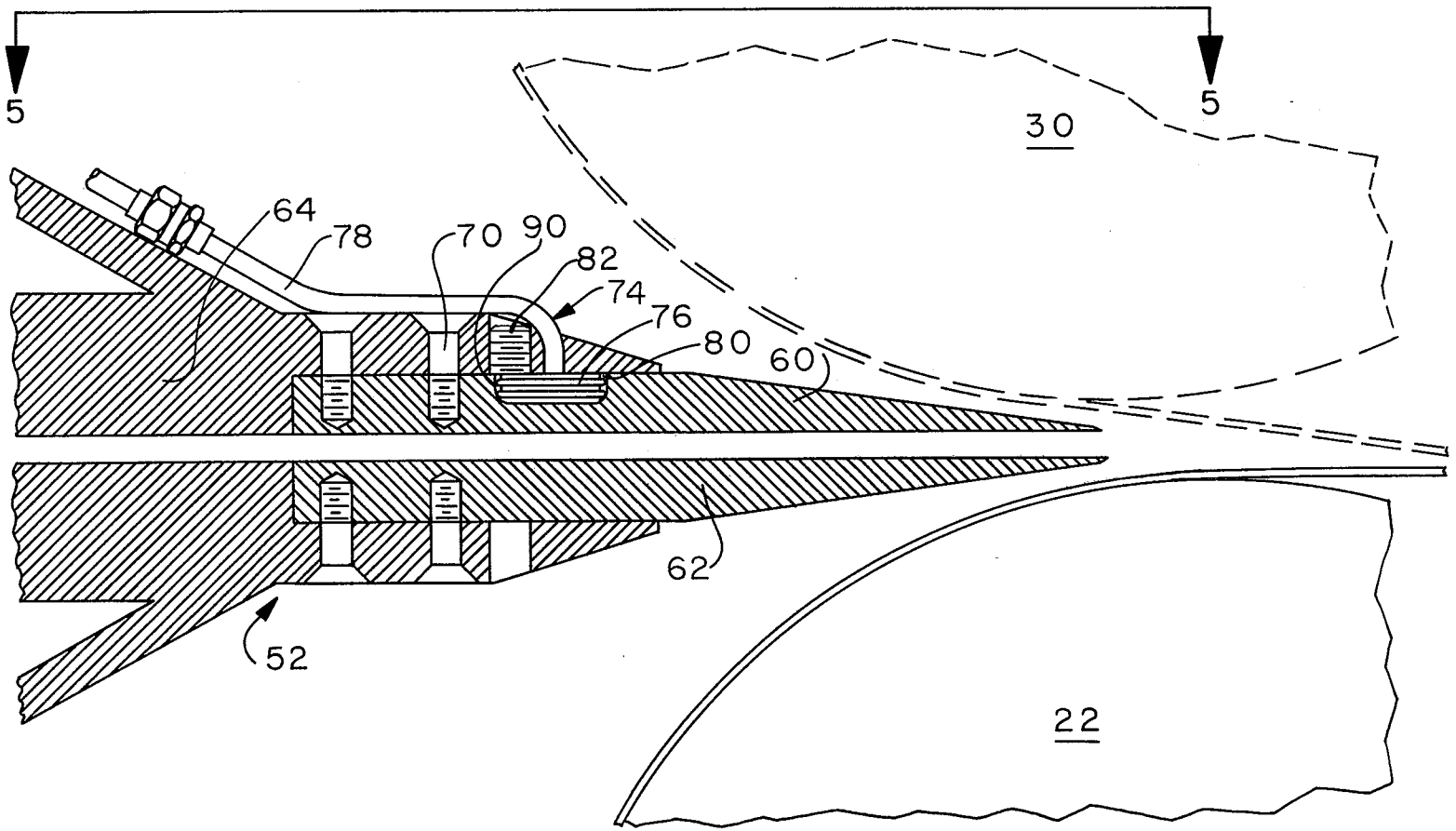
FIG. 4 is a view similar to FIG. 3 with an adjustable feature incorporating the present invention.
Figure 5:
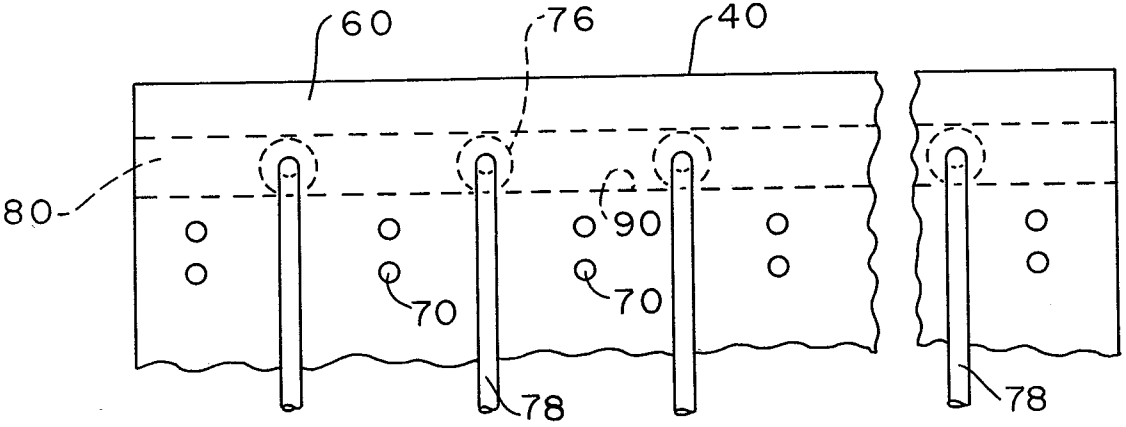
FIG. 5 is a top plan view of a portion of a slice lip taken along line 5—5 of FIG. 4.

A headbox 52 similar to that of FIG. 3 is shown in FIG. 4 with the replacement of the jacking screws with the adjustment mechanism comprising the present invention. The adjusting mechanism 74 of the present invention comprises an expandable member 76, such as a bellows, and fluid supply means 78 affixed thereto. The bellows is preferably made of a relatively nonflexible material such as stainless steel and may take any desired configuration. It is to be understood that while the adjusting mechanism 74 of the present invention is shown in FIG. 4 in the upper lip 60, it could, as a matter of choice, be located in the lower lip 62, or in both lips. Because the lips 60 and 62 are constructed of a relatively thick rigid material, considerable force must be exerted by the adjusting mechanism to effect deflection of the lip at the slice opening. Therefore, fluid pressures within the bellows 76 are generally required well in excess of 1,000 psi to effect expansion of the bellows and movement of the lip. For this purpose, it has been found convenient to utilize a liquid fluid, such as glycerin or water (or any other noncorrosive liquid) rather than air, for safety considerations.

In installing the present invention, a channel 80 is machined in the outer surface of lip 60 or 62 across its full width, and at appropriate locations, an aperture 82 is machined in the headbox support member 64 through which the fluid supply means 78 may be directed. The bellows 76 is positioned within channel 80 and secured to fluid supply means 78.

Figure 6:
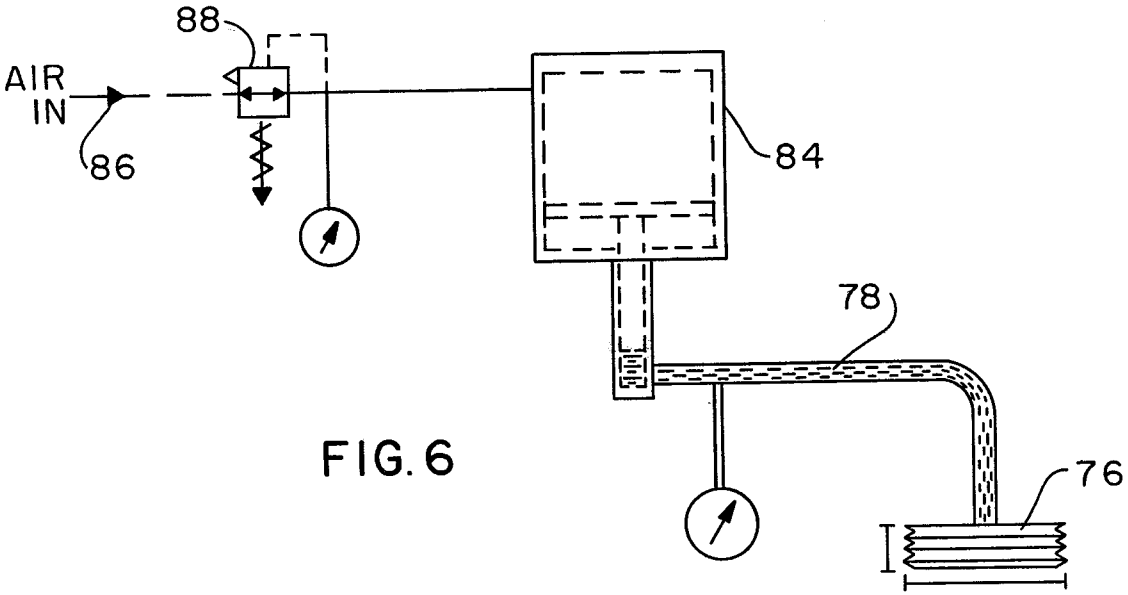
FIG. 6 is a diagrammatic view of the present invention.

As shown in FIG. 6, bellows 76 are connected to fluid supply means 78 which in turn are connected to an intensifier 84. Compressed air is supplied at 86 (a pressure of 50 to 80 psi has been found sufficient), controlled by regulator 88 prior to entering intensifier 84. The Applicant has found that an intensifier on the order of 30:1 producing a pressure of 1,500–2,500 psi in the liquid actuated bellows 76, functions adequately in the present invention. It is obviously a matter of choice as to the pressure of the air entering at 86 and the ratio of the intensifier to produce the desired pressure in bellows 76.

The channel 80 provided in lip 60 or 62 provides not only a convenient housing for bellows 76, but also serves as a uniform point for the lip to flex along its width upon actuation of any of the bellows 76. Expansion (actuation) of a bellows 76 as shown in FIG. 4, while the lip 60 is held in place by screws 70, will cause the lip 60 to bend, generally along the rearmost edge 90 of channel 80. Actuation of any of the individual bellows will result in localized deflection of the lip adjacent the actuated bellows. Of course, the fluid supply means 78, while shown external to the headbox in FIG. 4, could be machined within the support member 64 so that the entire actuating mechanism 74 is enclosed within the headbox and requires no additional space for placement or operation.

Many modern papermaking machines are provided with sensing devices located downstream of the headbox capable of sensing irregularities in the c.d. basis weight profile. While a typical tissue grade web may have an overall basis weight of 7.5 pounds per 2,880 square feet, the c.d. basis weight profile will rarely be uniform, and may change substantially from time to time during operation of the machine. Typically, a "target" basis weight is established (such as 7.5 or 15 pounds per 2,880 square feet) and an allowable range of basis weight variation, either higher or lower, is established about the target objective.

Figure 7:
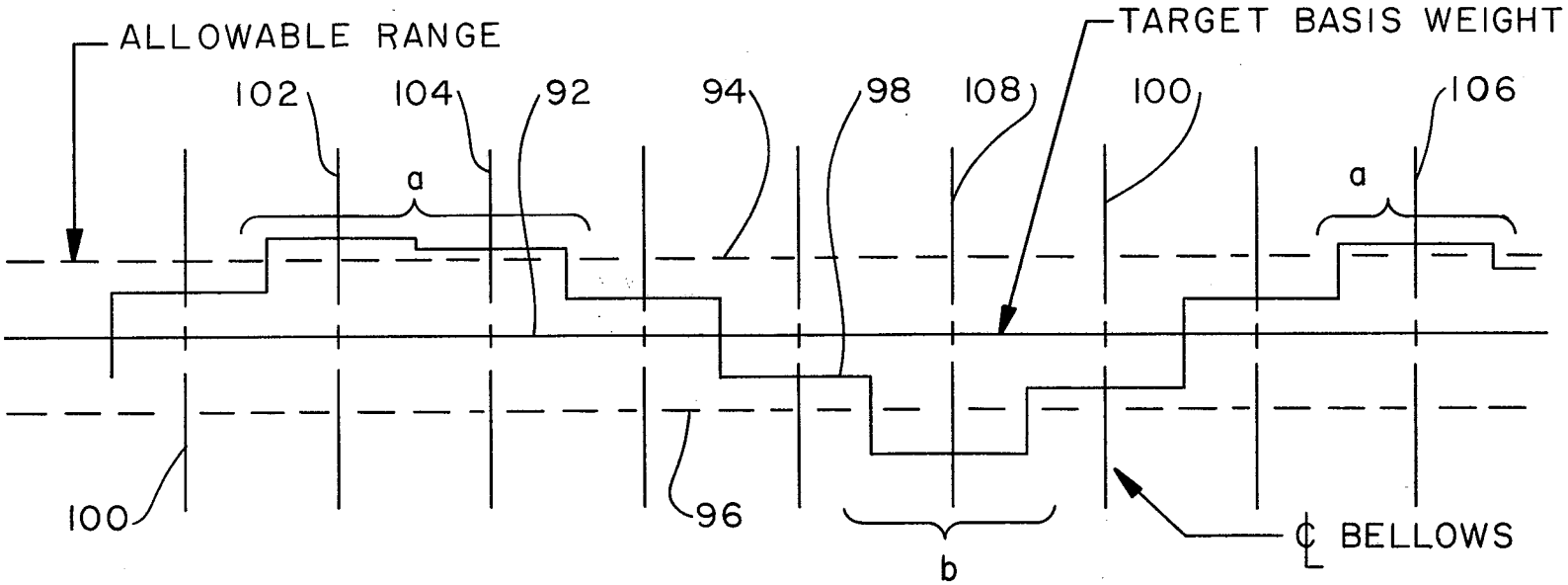
FIG. 7 is a diagrammatic representation of a basis weight variation profile printout.

As shown in FIG. 7, the target basis weight is indicated by line 92 and a range of permissible basis weight variance is indicated by lines 94 and 96, with the actual c.d. basis weight profile being indicated by line 98. While FIG. 7 represents only a relatively small portion of a c.d. basis weight profile, it can be seen that a representative sample may exhibit both high and low basis weight nonuniformities. Therefore, those areas bracketed by the letter [a] represent areas in which too much furnish is being supplied through the headbox, while that area bracketed by the letter [b] represents an area receiving too little furnish, the result being streaks of high and low basis weight in the finished product. The sensing device printout may be provided with an indication of the position of each bellows 76 across the headbox width, as indicated by lines 100. Therefore, bellows corresponding to lines 102, 104, and 106 may be actuated, thereby locally closing the slice opening 40 to reduce the quantity of furnish flowing therethrough in order to bring the basis weight into the allowable range of variations. Because this bellows mechanism is essentially a "push" device, as opposed to the "push-pull" devices of the prior art (FIG. 2), the lip may not be actively deformed to "open" the slice opening by pulling the lip upwardly. However, if a bellows had been previously actuated so that the lip was deflected inwardly and the slice opening locally closed, that area may thereafter be "opened" by simply reducing the pressure on the previously actuated bellows. Therefore, in the low basis weight portion bracketed by the letter [b], if the bellows indicated by line 108 had previously been actuated, this low basis weight variance may be corrected by reducing the pressure to bellows 108. However, if this bellows had not been previously expanded, this nonuniformity may not be corrected on the run by manipulating the adjusting mechansim 74.

If substantial low basis weight variations exist which may not be corrected as noted above, or if high basis weight variations exist that are too severe to be corrected by operation of adjusting mechanism 74, it may be necessary to shut down the machine, return all bellows to the zero or nonactuated position, and readjust the slice opening mechanically without the aid of adjusting mechanism 74. However, it has been found that such action is rarely necessary and may be accomplished during one of the routine shutdowns typically experienced by such machines.

When utilizing a bellows 76 of the type noted above (such as, of stainless steel) it has been found that a maximum deflection of the bellows, and consequently of the lip at the flexure point, of from 0.002 to 0.003 inches is sufficient to produce a deflection at the tip of the affected lip of approximately 0.015 inches. Such deflection causes little permanent stress on the lip, since it is well within the elastic limits of the metal utilized, and is sufficient to correct the majority of basis weight nonuniformities typically experienced.

The design is both aesthetically pleasing and functional as the component parts are "buried" into the original lip. This not only means a minimum problem with interference and stock build up but that the actuating mechanism is safe from active corrosion and/or damage.

While the invention has been described in connection with various embodiments, it will be understood that it is capable of further modification, and this application is intended to cover any modifications of the invention coming within the scope of the invention or limits of the appended claims.

What is claimed is:

1. In a headbox of the type utilized with a twin wire or crescent forming papermaking machine, said headbox having upper and lower substantially rigid slice lips affixed to upper and lower headbox support members extending across the full width of said papermaking machine and said upper and lower lips also extending substantially into a forming zone formed between converging wires or fabrics, the improvement comprising:

(a) actuating means in the form of bellows located within said upper or lower slice lip;

(b) fluid supply means for supplying a fluid to said actuating means under pressure of at least 1,000 pounds per square inch; and (c) a full width cross machine channel machined into the upper or lower slice lip, said bellows being located in said channel, and said channel being adjacent to said upper or said lower support means, said channel providing a uniform flexure point for deflection of said upper or lower slice lip.

2. The improvement as recited in claim 1, wherein, said slice lips extend at least 5 inches beyond said support members into said forming zone.

3. The improvement as recited in claim 1, wherein said actuating means are located at closely spaced intervals within said full width channel such that upon actuation of one or more actuating means, said slice lip will be deflected at said channel.

4. The improvement as recited in claim 1, wherein said fluid supply means comprises air compressor means to supply air at a pressure of at least 80 pounds per square inch, intensifier means connected to said liquid supply means, said intensifier means producing a pressure in said liquid supply means of at least 1,000 pounds per square inch.

5. The improvement as recited in claim 4, wherein said intensifier means comprises means to produce a pressure in said liquid supply means of approximately 2,500 pounds per square inch.

6. The improvement as recited in claim 1, wherein said actuating means are constructed of stainless steel.

7. The improvement as recited in claim 1, wherein said papermaking machine is provided with computer controlled automatic actuating means, said actuating means being actuated by sensing means located downstream of said headbox, such that nonuniformities in said paper web are detected by said sensing means and said actuating means are actuated in response thereto to reduce said nonuniformities.

* * * * *